United States Patent [19]

Gutai

[11] 4,047,669

[45] Sept. 13, 1977

[54] GAS NOZZLES FOR GAS USING APPLIANCES

[75] Inventor: Ferenc Gutai, Shipping Campden, England

[73] Assignee: Dynacast International Limited, Alcester, England

[21] Appl. No.: 685,494

[22] Filed: May 12, 1976

[30] Foreign Application Priority Data

May 15, 1975 United Kingdom ..... 20535/75

[51] Int. Cl.[2] ..... F23Q 1/02

[52] U.S. Cl. ..... 239/540; 239/579; 251/352; 431/277; 431/344

[58] Field of Search ..... 239/289, 436, 437, 443, 239/446–449, 579, 391, 394, 397, 540; 431/344, 276, 277, 254, 142, 143, 130, 131, 150; 251/350, 208, 352, 353

[56] References Cited

U.S. PATENT DOCUMENTS

| | | | |
|---|---|---|---|
| 1,092,062 | 3/1914 | Loney et al. | 251/352 X |
| 1,124,742 | 1/1915 | Hustus | 239/540 |
| 1,511,692 | 10/1924 | Vitek | 251/352 X |
| 2,388,093 | 10/1945 | Smith | 239/394 |
| 2,692,644 | 10/1954 | Murray | 239/540 X |
| 2,790,680 | 4/1957 | Rosholt | 239/394 |
| 3,234,762 | 2/1966 | Ohno | 431/131 X |
| 3,303,673 | 2/1967 | Ayres | 431/150 |
| 3,523,005 | 8/1970 | Piffath et al. | 431/344 |
| 3,867,090 | 2/1975 | Gili | 431/254 X |

FOREIGN PATENT DOCUMENTS

| | | | |
|---|---|---|---|
| 218,773 | 12/1961 | Austria | 431/130 |
| 103,045 | 1/1924 | Switzerland | 251/352 |
| 475,751 | 11/1937 | United Kingdom | 239/391 |

*Primary Examiner*—Evon C. Blunk
*Assistant Examiner*—Michael Mar

[57] ABSTRACT

A gas nozzle for a gas-using appliance containing a passage for gas formed at least in part in two members which are relatively rotatable while remaining in contact with one another over a surface of contact presented by each member. The passage in each member has a debouchment at the surface of contact on that member eccentric with respect to the axis of relative rotation of the members.

6 Claims, 5 Drawing Figures

GAS NOZZLES FOR GAS USING APPLIANCES

Figure 1:
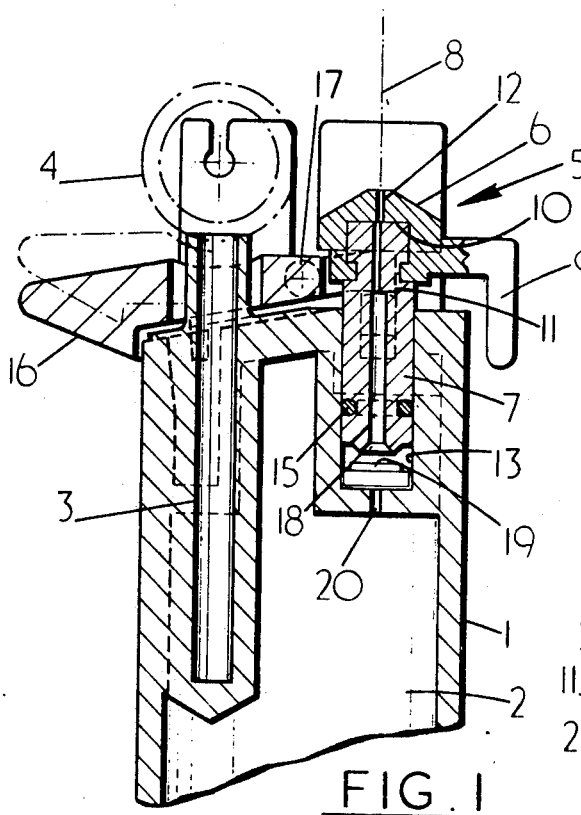
Figure 3:
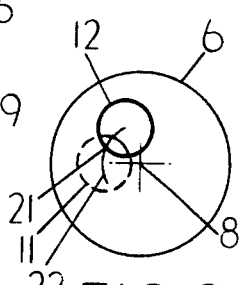
Figure 4:
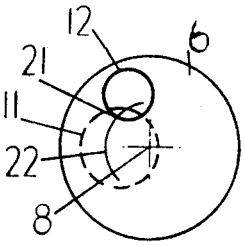

This invention relates to gas nozzles for gas-using applicances, especially appliances using liquified gas. Examples of such appliances are cigarette lighters and blow lamps and pilot jets for cookers.

Heretofore the difficulty in manufacturing a gas nozzle for such an appliance has been in providing a gas passageway of small enough diameter through the nozzle. This particularly applies to cigarette lighters and pilot jets although it also applies to some extent to small blow lamps. The difficulty is aggravated where as is usually the case it is required that the height of the issuing flame should be adjustable. Adjustment of the flame height is obtained by altering the rate of flow of gas through the nozzle. The minute consumption of gas by the small flame usually associated with an appliance of any of the types named and the comparatively high pressure at which liquified gas must be stored make it necessary to restrict the effective area of the gas passage to such a small value that to form a passage of the required area by drilling presents severe production problems. Attempts have been made to use a comparatively large diameter passage in conjunction with a tapered needle which can be moved axially into and out of the entrance to the passage. This has not proved effective because the restricted part of the passage is then an annulus the width of gap presented by which must be considerably smaller than the diameter of a circular passage of similar area. Thus even a slight misalignment of the needle with the passage lying within the normal tolerances results in the needle coming against one side of the passage when it is screwed into the passage and leaving a crescent-shaped gap which may have an irreducible area greater than required. In the customary construction the nozzle is movable towards and from a foraminous plate of deformable material so that when the gas-entry end of the nozzle is against the plate gas must pass through the foramina in the plate to reach the gas passage. Control is achieved by pressing the nozzle with greater or less force against the foraminous plate thus deforming the plate to a greater or less degree and varying the size of the foramina thus controlling the flow of gas. It wil be appreciated that this mode of control is imprecise and does not eliminate the necessity for providing a gas passage of extremely small diameter. The problem to be solved is to provide a nozzle which provides precise control over small gas flows while using gas passages which are of a size making it possible to produce them by cheap non-precision methods and even by a moulding operation. It is an object of the present invention to provide such a nozzle.

A gas nozzle according to the invention incorporates two members which are relatively rotatable while remaining in contact with one another over a surface of contact presented by each member, each member being penetrated by a passage which has a debouchment at the surface of contact on that member, the debouchment of the two passages at the respective surfaces of contact being eccentric with respect to the axis of relative rotation of the members by amounts such that the locus of the positions occupied by at least one point on the periphery of the debouchment of the passage in one member in different relative angular positions of the two members is an orbit a portion of which lies within the debouchment of the passage in the other member, i.e. said locus intersects the circumference of the debouchment of the passage in the other member.

One member may be arranged to be held against rotational movement in an appliance to which the nozzle assembly is to be fitted, the other member being rotatable around the non-rotating member.

The surfaces of contact on the members may be flat. Alternatively the surfaces of contact on the members may be coned, the surface of contact presented by one member being coned in such a way as to present a male surface of contact and the surface of contact presented by the other member being coned in such a way as to prevent a female surface of contact.

One member may be elongated, the surface of contact being located at one end of the member the other member then being in the shape of a cap fitting over the end of the elongated member formed with the surface of contact. In this construction the elongated member may be cylindrical, the axis of the cylinder being coincident with or parallel with the passage through the elongated member. The elongated member may be formed with an external circumferential groove, the member constituting the cap being formed with a skirt presenting an inwardly projecting flange engaged with the groove.

The elongated member carrying the other member constituting a cap may be slidable in a cylindrical socket forming part of a gas-consuming appliance, the bottom of the socket being provided with a sealing disc and with a gas entry passage debouching into the bottom portion of the socket, the end of the elongated member carrying the member in the shape of a cap projecting from the socket and the other end of the elongated member being engageable with the sealing plate in the bottom of the socket whereby to seal off the passage through the elongated member.

The cylindrical elongated member may be formed with an annular circumferential groove in the portion of the outer surface normally within the socket for reception of an O-ring as a sealing ring preventing escape of gas between the member and the wall of the socket.

As was mentioned above the cheapest method of forming such a fitment is by moulding and preferably by moulding in a plastics material. As the construction of the invention permits the use of large passages as will be explained later and modern techniques of moulding make it possible to mould the member in the form of a cap in situ on the end of the elongated member while leaving it rotatable about the elongated member, the nozzle of the invention is particularly suitable for moulding in plastics material. The difficulty then is that the heat of a flame burning at the end of the nozzle will through time damage the adjacent member. Even although combustion does not take place directly at the debouchment of the passage through the nozzle it takes place close enough for radiant heat to affect the material of the adjacent member.

In a further development of the invention the nozzle carries a combustion tube of a heat-resisting material aligned with the passage through the cap, said combustion tube being formed with at least one opening adjacent the nozzle for entry of air. The combustion tube may be attached to a base portion arranged to fit over the nozzle and the base portion may be integrally formed with at least one radial groove communicating with the exterior of the base member and forming an air passage into the combustion tube.

Figure 2:
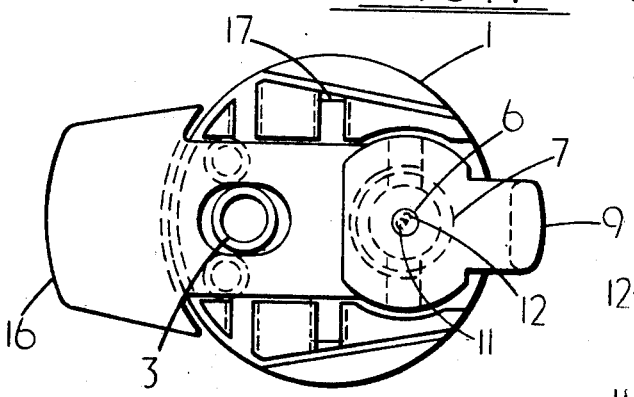
Figure 5:
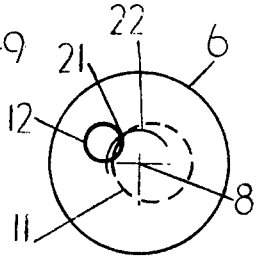

A practical embodiment of the invention is illustrated in the accompanying drawings in which FIG. 1 is a cross section of the upper portion of a cigarette lighter constituting one form of gas-using appliance incorporating the nozzle of the invention, FIG. 2 is a plan view of the appliance of FIG. 1 and FIGS. 3, 4 and 5 are views of the portion marked A in FIG. 2 to a larger scale than FIG. 2 showing different ways in which the two passages may be arranged so that they can be set to overlap one another to provide the required regulation.

In the drawings 1 denotes a cigarette lighter casing formed with a gas reservoir 2 and a socket for containing a flint and a spring urging the flint to move upwardly against a friction wheel 4 for use in striking sparks from the flint. 5 denotes a nozzle assembly constituted by two members 6 and 7 rotatable relative to one another about an axis 8, the elongated member 7 being held against rotation and the cap member 6 being rotatable about the elongated member 7 by means of the operating handle 9. The members 6 and 7 are formed with surfaces which form a surface of contact 10 and are also formed with passages 11 and 12 the axes of which are eccentric with respect to the axis of rotation 8 (see FIGS. 2, 3, 4 and 5). In the construction illustrated the nozzle assembly 5 is arranged to slide in a tubular socket 13 formed in the casing 1, a packing ring 14 preventing escape of gas past the sides of the member 7. The assembly is connected to one end of a lever 16 pivoted to the casing 1 at 17 and the lower end of the member 7 i.e. the end of the member 7 remote from the member 6 being formed with a seat 18 engageable with the sealing plate 19. 20 denotes a gas entry passage providing access from the reservoir 2 to the socket 13. In FIGS. 3, 4 and 5, 21 denotes the locus of the positions occupied by a point 22 on the periphery of the debouchment of the passage 12 through the member 6 as the member 6 rotates relatively to the member 7. Said locus is an orbit a portion of which lies within the debouchment of the passage 11 through the member 7, i.e. the locus 21 intersects the circumference of the debouchment of the passage 11.

In the operation of the gas nozzle of the invention, gas from the reservoir 2 entering the passage 11 in the member 7 moves through the passage 11 in the member 7 until it reaches the member 6, passes through the passage 12 in the member 6 and is discharged from the nozzle as a jet which is ignited to produce the required flame. Adjustment of the size of the flame i.e. adjustment of the flow of gas through the nozzle is obtained by rotating the member 6 relatively to the member 7. Normally the angular position of the member 6 with respect to the member 7 is chosen such that only a portion of the area of the debouchment of the passage 12 through the member 6 at the contact surface on the member 6 lies within the debouchment of the passage 11 through the member 7. The member 6 can occupy positions relative to the member 7 in which the debouchment of the passage 12 through the member 6 is non-coincident with the debouchment of the passage 11 through the member 7, other positions in which the debouchment of the passage 12 partly overlaps the debouchment of the passage 11 and if designed to do so can occupy a position in which the debouchment of the passage 12 lies wholly within the debouchment of the passage 11. Thus the member 6 may be moved to a position in which the passage through the nozzle is completely closed, a position in which the passage is wholly open and intermediate positions in which the passage through the nozzle is only partly open. It will thus be appreciated that even although the passages through the member 6 and through the member 7 may be large compared with the passages customarily used in the nozzles of small gas-consuming appliances the member 6 can occupy a position giving the same effect as a nozzle having a passage of a diameter which would normally be too small to mould. Normally once a position for the member 6 is found which provides the desired size of flame the member 6 will be left in that position, the act of shutting off the gas being performed by moving the complete nozzle consisting of the member 7 and the member 6 carried thereby axially to the position in the socket 13 in which the passage through the member 7 is closed by the sealing plate 19.

I claim:

1. A gas-using appliance comprising a gas container having an exterior tubular socket, the bottom of which is connected by a passage to the interior of the gas container and the top of which is open and a gas nozzle device, said gas nozzle device comprising an elongated piston member slidable in the tubular socket having one end projecting from the top of the socket and presenting a surface of contact, a cap member mounted on the projecting end of the piston member and presenting a surface of contact abutting against the surface of contact presented by the piston member, said cap and piston members being relatively rotatable and each having a passage one end of which is located in the surface of contact of the respective member and the other end of which is located at the other end of the respective member, the ends of the two passages on the respective surface of contact being eccentric with respect to the axis of relative rotation of the members by amounts such that the locus of at least one point on the periphery of the end of the passage in one member in different relative angular positions of the two members is an orbit, a portion of said orbit being within the periphery of the end of the passage in the other member, seal means located at the bottom of the socket, means for rotating the cap member and the piston member relatively to one another and means for reciprocating the piston member in the socket into and out of contact with the sealing means whereby to close and open said other end of the passage in the piston member.

2. A gas nozzle according to claim 1 characterized in that one member is arranged to be held against rotational movement and the other member is rotatable around the non-rotating member.

3. A gas nozzle according to claim 1 characterized in that the surfaces of contact of the members are flat.

4. A gas nozzle according to claim 9 characterized in that the surfaces of contact on the members are arcuate, the surface of contact presented by one member being curved in such a way as to present a male surface of contact and the surface of contact presented by the other member being curved in such a way as to present a female surface of contact.

5. A gas nozzle according to claim 1 characterized in that one member is elongated, its surface of contact being located at one end and the other member is in the shape of a cap fitting over the end of said elongated member formed with the surface of contact.

6. A gas nozzle according to claim 1 characterized in that the elongated member is formed with an external circumferential groove and the member constituting the cap is formed with a skirt presenting an inwardly projecting flange engaged with the groove.

* * * * *